US008727824B2

(12) United States Patent
Reeves et al.

(10) Patent No.: US 8,727,824 B2
(45) Date of Patent: May 20, 2014

(54) VENTING APPARATUS FOR A FLOATING BOARD

(75) Inventors: Kyle Reeves, Parksville (CA); Jeremy M. Wilkens, Newport Beach, CA (US)

(73) Assignee: Jimmy Styks LLC, Huntington Beach, CA (US)

( * ) Notice: Subject to any disclaimer, the term of this patent is extended or adjusted under 35 U.S.C. 154(b) by 153 days.

(21) Appl. No.: 13/271,128

(22) Filed: Oct. 11, 2011

(65) Prior Publication Data

US 2012/0088417 A1 Apr. 12, 2012

(30) Foreign Application Priority Data

Oct. 12, 2010 (CA) ..... 2717268

(51) Int. Cl.
*B63B 35/79* (2006.01)

(52) U.S. Cl.
USPC ..... 441/74; 114/288

(58) Field of Classification Search
USPC ..... 114/288; 441/65, 74
See application file for complete search history.

(56) References Cited

U.S. PATENT DOCUMENTS

| | | | | |
|---|---|---|---|---|
| 5,127,862 | A * | 7/1992 | Pia | 441/74 |
| 5,338,237 | A * | 8/1994 | Nealy | 441/74 |
| 6,042,439 | A * | 3/2000 | Parten | 441/65 |
| 6,247,985 | B1 * | 6/2001 | Block et al. | 441/74 |
| 6,431,932 | B1 * | 8/2002 | Pederson | 441/65 |
| 7,275,490 | B1 * | 10/2007 | Sanders et al. | 114/288 |

* cited by examiner

*Primary Examiner* — Lars A Olson
(74) *Attorney, Agent, or Firm* — Klarquist Sparkman, LLP

(57) ABSTRACT

An air vent for a floating board such as a paddleboard, which includes a tubular vent member that has an upper end and a lower end. A mounting supports the tubular vent member in a vertical orientation with the upper end of the tubular vent member protruding above an upper surface of the floating board. The tubular vent is mounted in a central zone comprising a central one third of the floating board, and along a crown positioned between a first side and a second side of the floating board.

6 Claims, 4 Drawing Sheets

VENTING APPARATUS FOR A FLOATING BOARD

CROSS REFERENCE TO RELATED APPLICATION

The present application claims priority from pending Canadian Patent Application No. 2,717,268, filed Oct. 12, 2010, which is incorporated herein by reference.

FIELD

There is described a venting apparatus for a hollow or foam core floating board such as a surfboard, a paddle board, or a sailboard and a hollow or foam core floating board having such a venting apparatus.

BACKGROUND

There are a variety of foam core or hollow floating board structures used in water sports. These structures are named after the sports with which they are used or the manner in which they are propelled on the water. Common examples are: a surfboard which is used for surfing, a paddleboard which is propelled by paddling and a sailboard which is propelled by sails. These floating board structures usually have an air vent. Venting of air is required to avoid internal structural stresses caused when there is a significant difference in temperature and pressure between ambient air external to the floating board and air trapped inside of the floating board. The air vent is typically recessed into a top or bottom end of the floating board spaced from a forward peripheral edge.

SUMMARY

According to one aspect of the invention, there is provided an air vent for a floating board that includes a tubular vent member. The tubular vent member has an upper end and a lower end. The tubular vent member has a first internal dimension at the upper end and a second internal dimension at the lower end with the first internal dimension being smaller than the second internal dimension. A mounting body is provided for supporting the tubular vent member in a vertical orientation.

According to another aspect of the invention, the mounting body has an insertion limiting flange which positions the upper end of the tubular vent member above an upper surface of the floating board when the mounting body is mounted into a floating board.

According to another aspect of the invention, the mounting body includes a recessed handle.

BRIEF DESCRIPTION OF THE DRAWINGS

These and other features will become more apparent from the following description in which reference is made to the appended drawings, the drawings are for the purpose of illustration only and are not intended to be in any way limiting, wherein.

DETAILED DESCRIPTION

Figure 1:
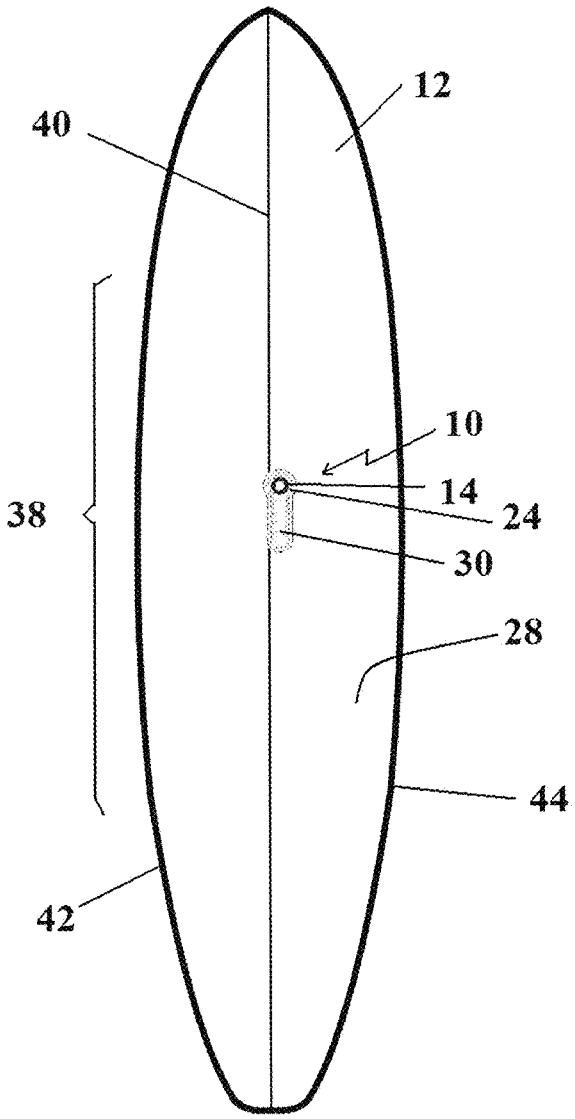
FIG. 1 is a top plan view of a paddle board with an air vent.

An air vent for a floating board generally identified by reference numeral 10, will now be described with reference to FIG. 1 through 6. The PRIOR ART will be described with reference to FIG. 7.

Figure 2:
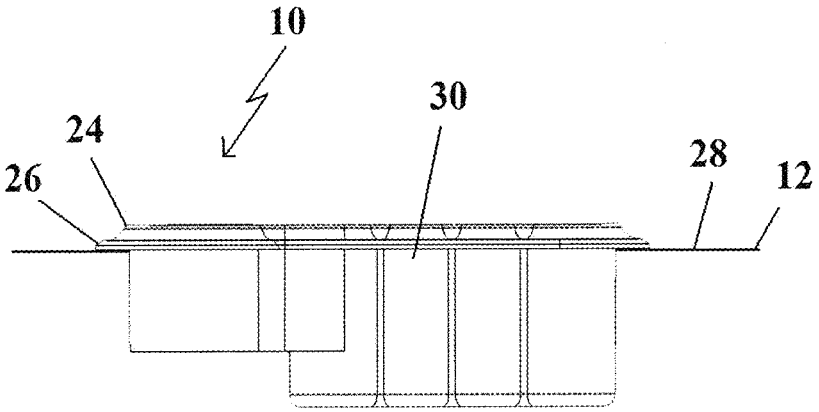
FIG. 2 is side elevation view in section of the air vent mounted in the paddle board.

Structure and Relationship of Parts:

Referring to FIG. 1, there is illustrated an air vent 10 for a floating board 12 which includes a tubular vent member 14. Floating board 12 can be hollow or can have a foam core. Referring to FIG. 2, tubular vent member 14 has an upper end 16 and a lower end 18. Referring FIG. 3, tubular vent member 14 has a first internal dimension 20 at upper end 16 and a second internal dimension 22 at lower end 18 with first internal dimension 20 being smaller than second internal dimension 22.

Figure 3:
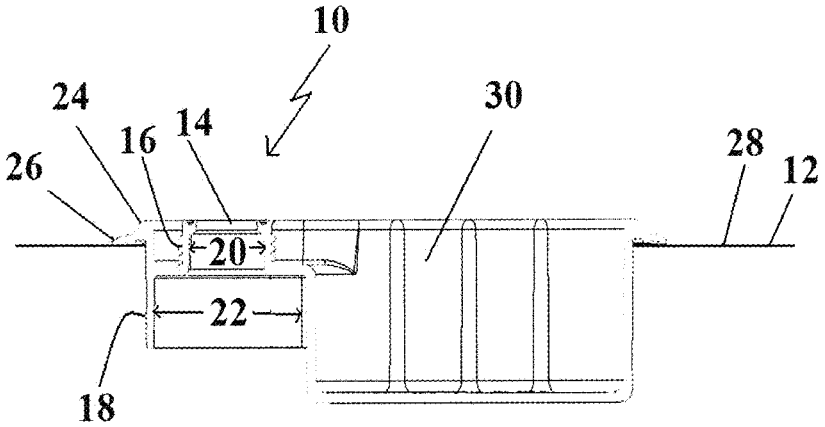
FIG. 3 is a side elevation view in section of the air vent mounted in the paddle board.
Figure 4:
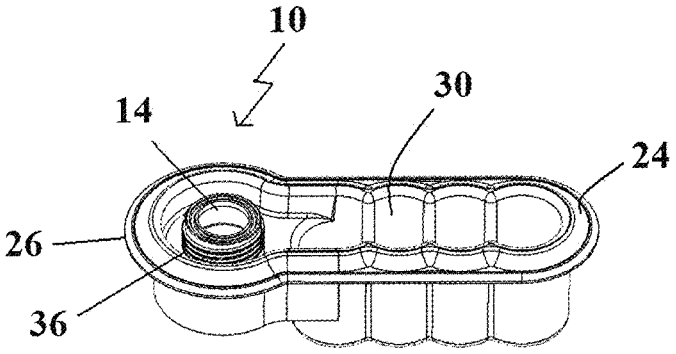
FIG. 4 is a perspective view of the air vent open without the plug.

Referring to FIG. 4, a mounting body 24 is provided for supporting tubular vent member 14 in a vertical orientation as shown in FIG. 2 and FIG. 3. Referring to FIG. 2 and FIG. 3, mounting body 24 has an insertion limiting flange 26 which positions upper end 16 of tubular vent member 14 above an upper surface 28 of floating board 12 when mounting body 24 is mounted into floating board 12.

Figure 6:
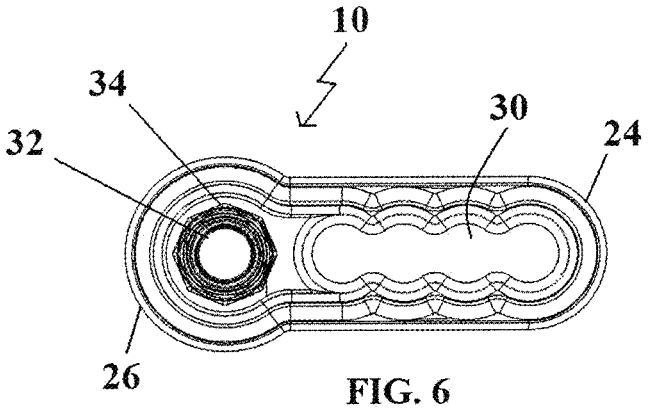
FIG. 6 is a top plan view of the air vent open without the plug.

Referring to FIG. 4, in the illustrated embodiment, mounting body 24 includes a recessed handle 30. It will be appreciated that mounting body 24 does not have to include handle 30, however the proximity of handle 30 to vent 10 can make the use of vent 10 more convenient. Referring to FIG. 6, a plug 32 is provided for closing upper end 16 of tubular vent member 14 illustrated in FIG. 3. Referring again to FIG. 6, in the illustrated embodiment 10, plug 32 is a threaded overlying cap 34 can be threaded onto mating threads 36 provided on upper end 16 of tubular vent member 14 illustrated in FIG. 4.

Referring to FIG. 1, in the illustrated embodiment, air vent 10 is mounted in a central zone generally referenced by numeral 38, which is comprised of a central one third of floating board 12 along a crown 40 positioned between a first side 42 and a second side 44 of floating board 12. It will be appreciated that air vent 10 could also be mounted in other positions along floating board 12 if desired.

Referring to FIG. 1, in the illustrated embodiment, floating board 12 is a paddle board, however it will be appreciated that air vent 10 could also be used on other types of floating boards 12 such as surfboards, sailboards, long boards, kite boards or other types of similar boards.

Operation:

Referring to FIG. 1, in order to use air vent 10, in combination with floating board 12, tubular vent 14 is mounted in central zone 38 which comprises central one third of floating board 12 along crown 40 positioned between first side 42 and second side 44 of floating board 12. As noted above, in the illustrated embodiment, floating board 12 is a paddle board, however it will be appreciated that air vent 10 could also be used on other types of floating boards 12 such as surfboards, sailboards, long boards, kite boards or other types of similar boards.

Figure 7:
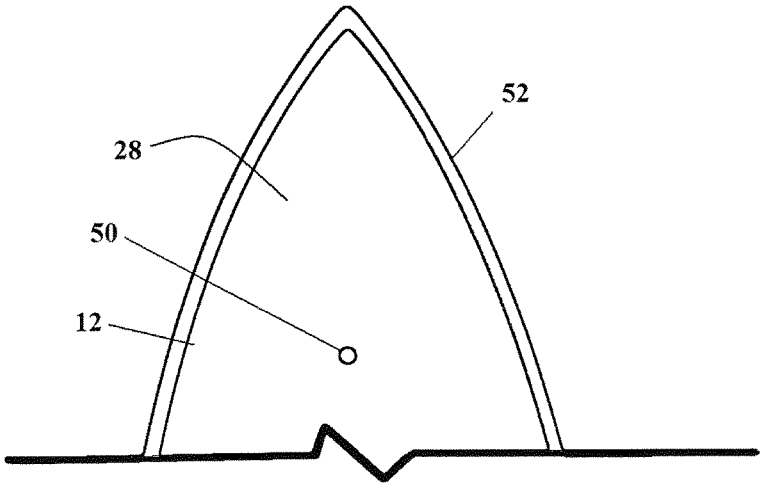
FIG. 7 PRIOR ART
FIG. 7 labelled as PRIOR ART is a top plan partial view of the a paddle board with an air vent.

Advantages:

Air vent 10 provides a number of advantages:

Referring to FIG. 3, upper end 16 of tubular vent member 14 is positioned above upper surface 28 of floating board 12 and creates a "snorkel effect" that would preclude or at least reduce water leakage into floating board 12, even if plug 32 illustrated in FIG. 6 were lost or removed. Referring to FIG. 6, as plug 32 that is used is threaded cap 34, user is able to open and close air vent 10 without the use of tools. Referring to FIG. 8 and FIG. 9, labelled prior art, vent systems 50 currently on the market require the use of a wrench or an Allen key. Referring to FIG. 7, air vents 50 of the prior art are typically recessed into top 28 of floating board 12 spaced from a forward peripheral edge 52.

Figure 5:
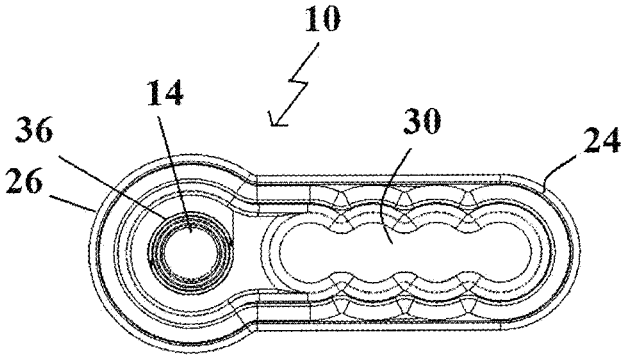
FIG. 5 is a top plan view of the air vent with closed with the plug.

Referring to FIG. 5. and FIG. 6, tubular vent member 14 when combined with recessed handle 30 can be centred in floating board 12 as illustrated in FIG. 1, for balance when carrying, and which also allows the air to travel less distance. In addition, the proximity to recessed handle 30 facilitates venting as a users hand is already positioned on or near recessed handle 30 when floating board 12 is being removed from the water which is when venting is typically required.

It is preferred that air vent 10 be made relatively large compared to present industry standards, such as air vents 50 illustrated in FIG. 7 labelled PRIOR ART, as this allows for faster air escaped in heating or cooling situations. Referring to FIG. 1 by way of example, air vent 10 of the present invention measures 0.367 square inches and whereas the Prior Art air vent 50 as shown in FIG. 7 measures only 0.145 square inches.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The following claims are to be understood to include what is specifically illustrated and described above, what is conceptually equivalent, and what can be obviously substituted. Those skilled in the art will appreciate that various adaptations and modifications of the described embodiments can be configured without departing from the scope of the claims. The illustrated embodiments have been set forth only as examples and should not be taken as limiting the invention. It is to be understood that, within the scope of the following claims, the invention may be practiced other than as specifically illustrated and described.

What is claimed is:

1. An air vent for a floating board, comprising in combination:

a floating board;

a tubular vent member having an upper end and a lower end, the tubular vent member having a first internal dimension at the upper end and a second internal dimension at the lower end, the first internal dimension being smaller than the second internal dimension, a mounting body supporting the tubular vent member in a vertical orientation, the mounting body having an insertion limiting flange which positions the upper end of the tubular vent member above an upper surface of the floating board when the mounting body is mounted into a floating board, the mounting body including a recessed handle; and a plug being provided in the form of an overlying cap which closes the upper end of the tubular vent member;

the tubular vent being mounted in a central zone comprising a central one third of the floating board along a crown positioned between a first side and a second side of the floating board.

2. The air vent of claim 1, wherein the floating board is a paddleboard.

3. The air vent of claim 2, wherein the floating board is hollow.

4. The air vent of claim 3, wherein the floating board has a foam core.

5. An air vent for a floating board, comprising:

a tubular vent member having an upper end and a lower end, the lower end being in communication with an interior cavity of the floating board;

a mounting body supporting the tubular vent member in a vertical orientation, the mounting body comprising a recessed handle; and a plug closing the upper end of the tubular vent member.

6. An air vent for a floating board, comprising:

a tubular vent member having an upper end and a lower end, the lower end being in communication with an interior cavity of the floating board; and a mounting body supporting the tubular vent member in a vertical orientation, the mounting body comprising a recessed handle mounted in a central zone comprised of a central one third of the floating board along a crown positioned between a first side and a second side of the floating board.

* * * * *